US009980573B2

(12) United States Patent
Bennetts

(10) Patent No.: US 9,980,573 B2
(45) Date of Patent: May 29, 2018

(54) HEAD SUPPORT

(71) Applicant: EC Medica Ltd, Southport (GB)

(72) Inventor: Paul Shane Bennetts, Southport (GB)

(73) Assignee: EC MEDICA LTD. (GB)

( * ) Notice: Subject to any disclaimer, the term of this patent is extended or adjusted under 35 U.S.C. 154(b) by 0 days. days.

(21) Appl. No.: 15/607,427

(22) Filed: May 26, 2017

(65) Prior Publication Data

US 2017/0340127 A1 Nov. 30, 2017

(30) Foreign Application Priority Data

May 27, 2016 (GB) ..... 1609405.4

(51) Int. Cl.

| | |
|---|---|
| ***A47C 20/02*** | (2006.01) |
| ***A47G 9/10*** | (2006.01) |
| ***A61G 13/12*** | (2006.01) |
| *A61G 7/07* | (2006.01) |

(52) U.S. Cl.

CPC ..... *A47C 20/026* (2013.01); *A47G 9/1054* (2013.01); *A61G 13/12* (2013.01); *A61G 7/072* (2013.01); *A61G 13/121* (2013.01); *A61G 2200/325* (2013.01)

(58) Field of Classification Search

CPC ..... A61G 13/121; A61G 7/072; A61G 13/12; A61G 2200/325; A47G 9/1054; A47C 20/026

USPC ..... 128/845

See application file for complete search history.

(56) References Cited

U.S. PATENT DOCUMENTS

| | | | | | |
|---|---|---|---|---|---|
| 3,901,228 | A * | 8/1975 | Brown | A61F 13/069 | 128/882 |
| 4,058,112 | A * | 11/1977 | Johnson | A61B 6/0421 | 128/846 |
| 4,752,064 | A * | 6/1988 | Voss | A61G 13/12 | 5/622 |
| D298,992 | S * | 12/1988 | Voss | 5/638 | |
| D337,914 | S * | 8/1993 | McDonald | 5/638 | |
| 5,269,035 | A * | 12/1993 | Hartunian | A47C 20/026 | 5/637 |
| D456,516 | S * | 4/2002 | Cheshaek | 5/638 | |
| 6,427,272 | B1 * | 8/2002 | Yacoub | A61G 7/07 | 5/637 |
| 6,637,058 | B1 * | 10/2003 | Lamb | A61G 13/12 | 5/636 |
| 6,842,924 | B1 * | 1/2005 | Walters | A47C 20/026 | 5/636 |
| 7,882,583 | B2 * | 2/2011 | Skripps | A61G 13/04 | 5/621 |

(Continued)

*Primary Examiner* — Eric J Kurilla

(74) *Attorney, Agent, or Firm* — Richard A. Castellano; DNL Zito Castellano

(57) ABSTRACT

The present invention relates to a head support for supporting a patient's head while the patient is in a prone position. The head support comprises a body of compliant material whose shape provides a forehead support region, at least one further support region for supporting a lower portion of the patient's face, and a void which accommodates the patient's eyes, nose and mouth in use. According to one aspect of the invention, a viewing opening is provided which faces laterally and provides in use a line of sight from the exterior of the head support into the void, the viewing opening having a periphery which is an unbroken loop.

18 Claims, 4 Drawing Sheets

(56) References Cited

U.S. PATENT DOCUMENTS

| | | | | |
|---|---|---|---|---|
| 8,269,825 | B1 * | 9/2012 | Vu | A61B 5/1106 348/77 |
| D718,074 | S * | 11/2014 | Savolainen | D6/601 |
| 9,089,463 | B1 * | 7/2015 | Wood | A61G 7/072 |
| D773,675 | S * | 12/2016 | Bauman | D24/184 |
| 2015/0040322 | A1 * | 2/2015 | Cheng | A47G 9/1054 5/638 |

* cited by examiner

HEAD SUPPORT

RELATED APPLICATION DATA

This application claims the benefit of priority from GB Application No. GB1609405.4, filed May 27, 2016, the entire disclosure of which is hereby incorporated by reference herein in its entirety.

TECHNICAL FIELD

The present invention relates to apparatus for supporting a patient's head while the patient is in a prone position. It is especially, but not necessarily exclusively, suitable for use in medical procedures including surgery.

BACKGROUND ART

Various medical and therapeutic procedures require the patient to lie in a prone position—that is, to lie on his/her front, facing downwards. In particular, a range of surgical procedures including for example certain forms of spinal surgery require this mode of patient presentation. If the patient were simply supported on a flat bed, the head would naturally be turned to one side or the other but this is not desirable. Among other unwelcome effects, it puts the cervical spine in an abnormal position and potentially constricts the trachea and larynx.

It is known instead to provide a shaped head support upon which the prone patient's face rests. The support can maintain the head in a generally upright orientation. That is to say that the plane of symmetry of the head is roughly vertical. The support is shaped to engage with selected regions of the face and to generally conform to the face's shape in these regions, tending to avoid local pressure concentration. Compliant foam may form the parts of the support on which the face rests.

The shape of some known head supports provides cutways in regions corresponding to the patient's nose and mouth, leaving the airways clear. The cut-aways also typically extend to the region of the patient's eyes to prevent pressure from being applied to them. Sustained pressure to the eyeball can otherwise cause serious injury to the visual system.

Head supports may comprise a generally rigid frame with a shaped foam insert. In other instances, a unitary body of foam forms the entire support, and may for example have a flat under-surface to rest on an operating table.

During surgery, the anaesthetist and others may need to observe the patient's face. Of course, a portion of the face is in contact with the support, but various known head supports provide for observation of the eye, nose and mouth region (which are left clear by the aforementioned cut-aways) being shaped to provide a line of sight from the outside of the support to these parts of the face. In certain known one-piece foam head supports, this is achieved by cutting away regions of the support on either side of the face to form downwardly open viewing channels. Such a support may be placed upon an upwardly facing mirror, so that the reflection of the face can be viewed from above in the mirror, through the viewing channels. But the viewing channels can create a problem in that they impair the rigidity of the head support, which may consequently bend in use in a manner which impairs its function. Bending can lead to loss of control of head orientation and to undesirable local pressure concentration.

Head supports for use in surgery may need to provide a route for one or more conduits to be led to the mouth and/or nose of the patient. Specifically, provision typically needs to be made for routing of an endotracheal tube. Other forms of conduit may additionally or alternatively be required, such as nasogastric tubes. The term "conduit" as used herein should be understood broadly to encompass any form of elongate member to be led to the patient's face. Consideration needs to be given to the process by which the conduit is to be introduced to the head support, since it is often the case that neither end of the conduit is free to be longitudinally fed into the head support, e.g. because the patient is already intubated when placed upon the operating table. An upwardly open channel leading from the periphery of the support to the region of the nose/mouth may be formed in the head support to receive the conduit or member. This makes it straightforward to introduce the conduit but can create a different problem since regions of foam material adjacent the channel are deprived of support by it and may deform excessively, impairing the support function. For instance, a region of the support lying beneath the patient's chin may collapse toward the channel, causing control of the orientation of the patient's head to be impaired. Other known head supports provide a downwardly open channel for the same purpose, but this too can undesirably impair rigidity of the head support and introduction of the endotracheal tube in this case requires access to the underside of the head support (e.g. by lifting it from the table) which is less convenient.

U.S. Pat. No. 5,269,035 (Hartunian) discloses a head support whose shape is generally cubic but has first and second "arcuate-shaped cavities" formed in its upper surface, one to support the patient's forehead and one to support the chin. Between these cavities is an opening through which the face of the patient is visible. A downwardly open, laterally extending channel of the type mentioned above provides a route for an endotracheal tube.

U.S. Pat. No. 4,757,983 (Ray et al.) discloses a head and chin rest for use in surgical operations. There are several embodiments but in each, cushions of the head and chin rests are separately formed and are physically separated, giving access to, and visibility of, much of the patient's face. The separation of the supports is adjustable. This necessitates a relatively elaborate rigid support structure for the cushions.

U.S. Pat. No. 4,752,064 (Voss) discloses a generally cuboidal pillow with a T-shaped void in its upper surface to accommodate the mouth, nose and eyes. Channels formed in the pillow's under-surface can be used to accommodate an endotracheal tube. These channels are shown to be downwardly open.

U.S. Pat. No. 5,613,501 (Michelson) discloses a face support which has a concave curved upper surface to contact the face and which also has a concave lower surface, so that the support deforms under the weight applied to it in use, tending to cause it to press on the sides of the patient's face. This prior art document illustrates the provision of an upwardly open channel for an endotracheal tube, which is considered to give rise to the potential problem of undesirable deformation of the support's shape in use which are discussed above.

U.S. Pat. No. 3,337,883 (Allison) discloses a head rest having a trough-shaped body of plastics sheet material carrying a resilient cushioning pad, both being cut away to accommodate the eyes, nose and mouth. What rigidity this structure has appears to be contributed by the plastics body.

U.S. Pat. No. 3,694,831 (Treace) discloses a multi-purpose medical head support having a base portion and a pair of wedge-shaped pads fixedly mounted on the base portion.

No provision appears to be made for an endotracheal tube or for observation of the patient's face.

SUMMARY OF THE INVENTION

Various aspects of the invention are set forth in the appended claims.

According to one aspect of the invention, there is provided a head support for supporting a patient's head while the patient is in a prone position, the head support comprising a body of compliant material whose shape provides a forehead support region, at least one further support region for supporting a lower portion of the patient's face, and a void which accommodates the patient's eyes, nose and mouth in use, wherein a viewing opening is provided which faces laterally and provides in use a line of sight from the exterior of the head support into the void, the viewing opening having a periphery which is an unbroken loop.

According to another aspect of the invention, there is provided a head support for supporting a patient's head while the patient is in a prone position, the head support comprising a body of compliant material whose shape provides a forehead support region, at least one further support region for supporting a lower portion of the patient's face, and a void which accommodates the patient's eyes, nose and mouth in use, the head support further comprising a conduit-routing opening through which the void communicates with the exterior of the head support, and a slit which extends from the conduit-routing opening's periphery, so that by deforming the compliant material of the head support, the slit is able to be opened to enable a conduit to be introduced through the open slit to the conduit-routing opening, after which the head support is able to recover its original shape.

According to a yet further aspect of the invention, there is provided a head support for supporting a patient's head while the patient is in a prone position, the head support comprising a body of compliant material whose shape provides a forehead support region, at least one further support region for supporting a lower portion of the patient's face, and a void which accommodates the patient's eyes, nose and mouth in use, wherein a viewing opening is provided which faces laterally and provides in use a line of sight from the exterior of the head support into the void, the viewing opening having a periphery which is an unbroken loop, and wherein the head support comprises a conduit-routing opening through which the void communicates with the exterior of the head support and which is configured to receive a conduit led, in use, from the said exterior to the face of the patient, the conduit-routing opening having a periphery which is a closed loop save for a slit which extends substantially horizontally from the conduit-routing opening's periphery, so that by deforming the compliant material of the head support, the slit is able to be opened to enable a conduit to be introduced through the open slit to the conduit-routing opening, after which the head support is able to recover its original shape.

Suitably, the head support has a peripheral wall through which the viewing opening passes, material of the peripheral wall being unbroken above and below the viewing opening. The void may comprise an upwardly open recess with a base wall. Suitably, the base wall extends continuously from a proximal end of the void to a distal end of the void.

The base wall may be configured to support a mirror in a position which is such that in use a reflection of the face of the patient from the mirror is viewable through the viewing opening. The base may support a mirror in a position which is such that in use a reflection of the face of the patient from the mirror is viewable through the viewing opening.

Suitably, the viewing opening is on a first side of the head support and a further viewing opening is provided on a second side of the head support opposite the first.

The main body is suitably manufactured from a unitary body of foam material. The head support is suitably adapted to be placed upon a flat surface and to be used without any additional supporting structure or cradle. An under-side of the head support is, therefore, possibly substantially flat. However, in other embodiments of the invention, an under-side of the head support may have a convex curved profile, for example, to fit into a cradle or other support structure.

Where provided, the support regions may comprise a pair of cheek support regions which lie on either side of a plane of symmetry of the head support and which incline downwardly toward the said plane.

In plan, the void suitably comprises a transverse region providing clearance at least for the eyes of the patient and a longitudinal region providing clearance at least for the nose of the patient. The forehead support region is suitably concave in both transverse and longitudinal planes. Preferably, material on one side of the slit contacts material on the other side of the slit when the head support is not deformed by an applied force.

The conduit-routing opening suitably faces along a lateral direction and/or may emerge into the void in a region of the head support which is adjacent the lower face of the patient, in use. The conduit-routing opening may be circular.

The head support suitably has an upright peripheral wall around the void and the conduit-routing opening extends through the peripheral wall. The peripheral wall may be divided in a chin region of the head support and the slit extends to an edge formed by this divide. Suitably, the slit is inclined by not more than thirty degrees to the horizontal, and preferably, the slit lies in a plane which is substantially horizontal.

Preferably, the periphery of the conduit-routing opening is, save for the slit, an unbroken loop.

The void may intersect the under-side of the head support.

A yet further aspect of the invention provides a method of routing a conduit into a head support for supporting a patient's head while the patient is in a prone position, the head support comprising a body of compliant material whose shape provides a forehead support region, at least one further support region for supporting a lower portion of the patient's face, and a void which accommodates the patient's eyes, nose and mouth in use, the head support further comprising a conduit-routing opening through which the void communicates with the exterior of the head support, and a slit which extends from the conduit-routing opening's periphery, and the method comprising deforming the compliant material of the head support to open the slit, introducing the conduit along a direction transverse to its length through the slit into the conduit-routing opening, and releasing the head support causing it to recover its original shape and close the slit.

BRIEF DESCRIPTION OF THE DRAWINGS

Specific embodiments of the present invention will now be described, by way of example only, with reference to the accompanying drawings, in which.

DESCRIPTION OF EMBODIMENTS

First Example

The first head support 10 represented in FIGS. 1 to 4 is intended for use in surgical procedures, with the patient in the prone position. It comprises a unitary body of foam material. Suitable foams for the purpose are known to the skilled person. Polyurethane foam is one suitable material. The material is compliant, which is to say that it is capable of yielding somewhat under the pressure applied to it in use by the face of the patient. It is also sufficiently resilient to recover its original shape after removal of that pressure.

The head support 10 may be offered as a single use (disposable) item. By avoiding re-use, transmission of infection from one patient to another is avoided without need of elaborate measures for disinfection. It may be supplied to the user in a sealed bag, giving protection against its contamination prior to use.

The head support 10 in this particular embodiment does not require, and is not provided with, any external frame or cradle. It has an under-surface 12 for resting on a suitable supporting surface, e.g. the surface of an operating table. In the present embodiment, the under-surface 12 is flat.

Figure 1:
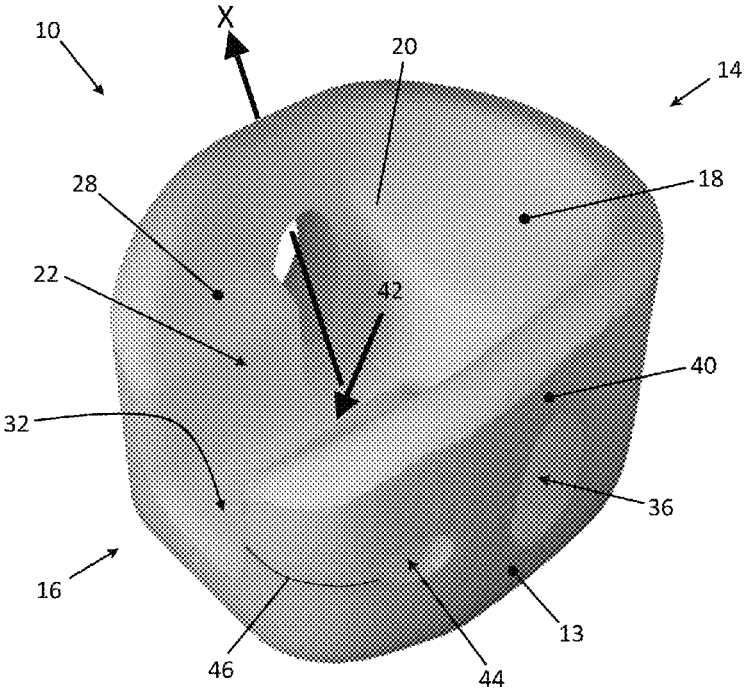
FIG. 1 represents a first head support embodying the present invention, viewed from above and one side.
Figure 2:
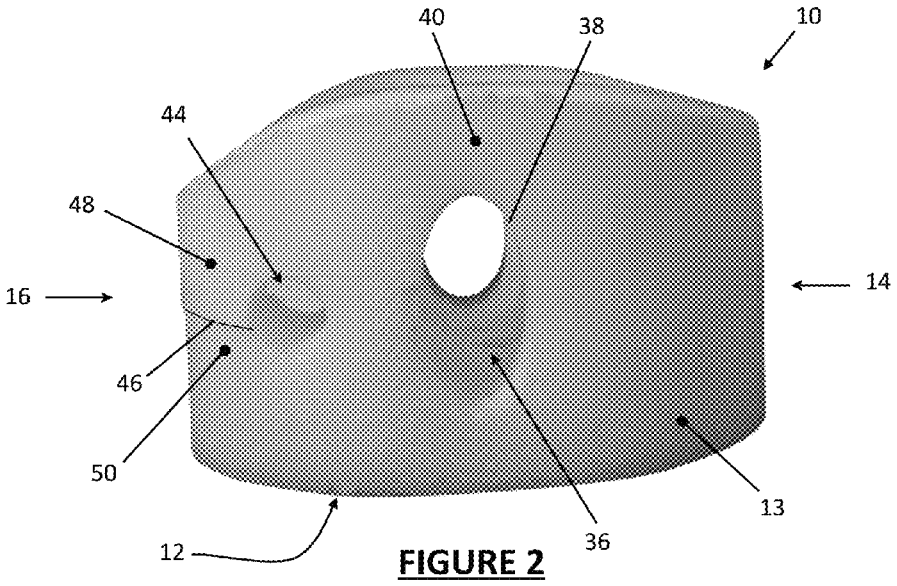
FIG. 2 represents the first head support viewed from one side.
Figure 3:
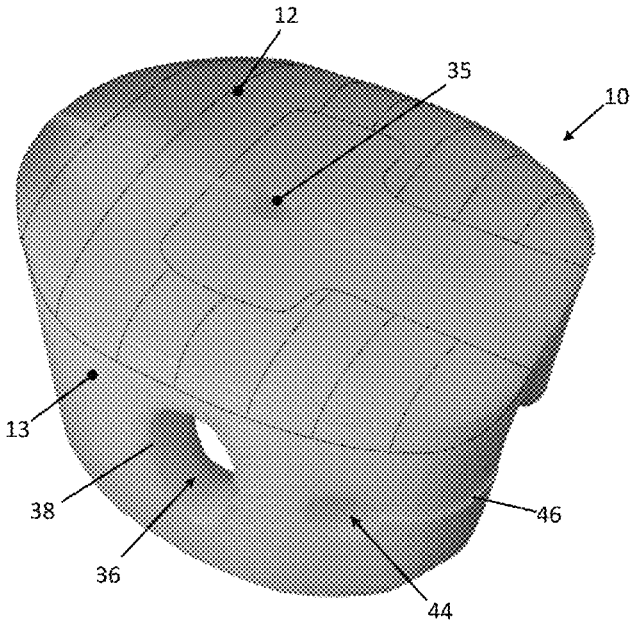
FIG. 3 represents the first head support inverted to show its under-surface and one side.
Figure 4:
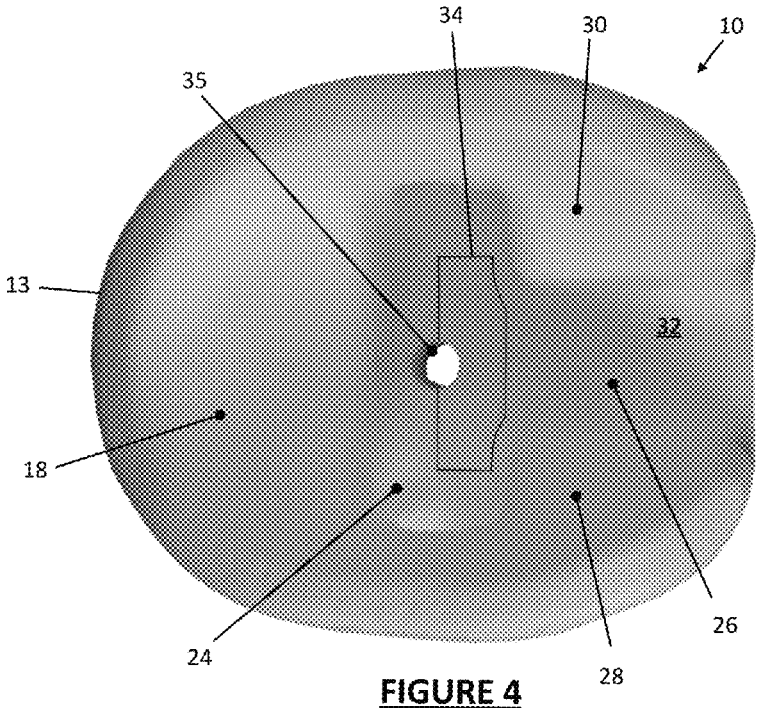
FIG. 4 represents the first head support viewed from above.

Referring to FIG. 3 of the drawings, however, an alternate embodiment of the invention sees the under-surface 12 of the head support having a curved, convex profile (as indicated by the dashed lines in FIG. 3). The purpose of this is to enable the head support under-surface 12 to rest stably upon a correspondingly-shaped concave support surface, such as may be found, for example, in an Allen® "Spine System" operating table, or in an Allen® "C-Prone Head Positioner" system. The head support 10 is nevertheless self-supporting, i.e. not requiring a cradle/stand, but can nevertheless be positioned on a non-flat support surface. The dashed lines in FIG. 3 are representative only of a possible of a curved under-surface profile. Also, a cut through can be provided so that the void 22 intersects the under-surface.

The head support 10 has a roughly oval plan shape (see FIG. 4 in particular) defined by an upright peripheral wall 13, although other plan shapes are possible within the scope of the present invention. The head support 10 is generally symmetrical about a longitudinal plane. One end 14 of the head support 10 lies beneath the patient's forehead in use and will be referred to as the distal end. An opposite end 16 of the head support 10 lies beneath the lower part of the face of the patient in use and will be referred to as the proximal end.

The head support 10 is recessed to enable it to support the head of the prone patient in a generally upright orientation. In use the patient's face is directed downwards onto the head support 10 to rest upon it. The head support 10 has a forehead support portion 18 which is shaped to conform to and support that part of the patient's head, having concave curvature in both transverse and longitudinal upright planes. The proximal extremity of the forehead support portion 18 is defined by a transverse radiussed vertex 20 where the forehead support portion 18 meets a deeper void 22.

In the present embodiment the void 22 is generally "T" shaped in plan (see FIG. 4 in particular) having a transverse portion 24 which provides clearance for the eyes and the upper part of the nose of the patient, preventing these parts from contacting the head support 10 when the face is correctly situated upon it, and a longitudinal portion 26 extending in the proximal direction which provides clearance for the patient's mouth and also in this embodiment for at least a central portion of the patient's chin. Cheek support portions 28, 30 are provided to the left and the right of the longitudinal portion 26 and are shaped to generally conform to the shape of the patient's cheeks, being downwardly inclined toward the longitudinal plane of symmetry of the head support 10.

The void 22 does not extend right the way through the depth of the head support 10. Instead it has a bottom wall 32. In the present embodiment, the bottom wall 32 is able to support a viewing mirror 34. More specifically the present embodiment has a shallow recess formed in the bottom wall 32 to locate the mirror, which faces upwardly to reflect an image of part of the patient's face, including the eyes. The recess is not seen in the drawings but its plan shape matches that of the mirror 34. A finger hole 35 enables the mirror to be pushed out of the recess 34 after use. The finger hole 35 can also be used to pass a sensor wire, such as a temperature probe, up through the bottom wall 32 of the head support 10 so that it can enter the patient's nose without fouling the endotracheal tube.

A viewing opening 36 is provided on a side of the head support 10 to enable observation of the patient's face in use. The viewing opening 36 extends through the peripheral wall 13 to communicate with the support's internal void 22. It faces generally laterally. The viewing opening is not formed by an upwardly or downwardly open channel, as in some of the prior art discussed above. Rather, its periphery 38 forms a continuous loop. Above the viewing opening 36, an unbroken portion 40 of the peripheral wall 13 connects proximal and distal portions 14, 16 of the head support. Beneath the viewing opening 36, the bottom wall 32 provides an unbroken connection between said proximal and distal portions. This formation contributes to the stability of the head support 10 under load, resisting the undesirable bending made possible by the downwardly open viewing channels found in certain prior art.

Observation of part of the face is possible by direct line of sight through the viewing opening 36, but a wider field of view is provided by the optional mirror 34 beneath the patient's face. It will be understood by the skilled person that an observer will place his/her eyes to one side of the head support 10 and somewhat above it (location X in FIG. 1) to view the mirror along a downwardly inclined direction. The path of a light ray to the viewer's eye is represented by arrows 42 in FIG. 1. In other situations, an anaesthetist may simply insert his/her fingers through the openings 36 to feel for the correct positioning of the patient's eyes relative to the head support 10.

Provision is made for an elongate member, specifically an endotracheal tube (not shown) to be routed from the exterior of the head support 10 into the void 22 and so to the patient's mouth. In other instances, the member in question may be led to the nose, or may be of a different type. For this purpose, the head support 10 has a conduit-routing opening 44 through which the void 22 communicates with the exterior of the head support 10. In the present embodiment, the conduit-routing opening faces laterally and extends through the peripheral wall 13. It is formed in a proximal region of the head support, thus emerging into the void 22 in the vicinity of the patient's mouth. To enable the conduit to be introduced into the conduit-routing opening 44 despite neither end of the conduit being free (as for example in the case where the patient is brought to the table already intubated), a split 46 extends from the periphery of the conduit-routing opening 44 to an edge of the material forming the head support 10. Thus, the conduit 10 can be introduced laterally (with respect to its own length) through the slit and so into the conduit-routing opening 44. In the present embodiment, this involves some deformation of the foam material of the head support 10. A portion 48 to one side of the slit is separated from a portion 50 to the other side (see FIG. 2), to enable the conduit to be introduced. Due to the resilient nature of the foam it recovers its original shape once released.

In the present embodiment, the split 46 lies in a roughly horizontal plane. The weight of the patient's head acts of course along a vertical direction, so that it urges the two sides of the split 46 together. Hence the rigidity of the head support 10 against this loading is not materially impaired by the split 46. The material 48, 50 above and below the split 46 serves to withstand vertical loading just as if the split were not present. Some curvature or inclination of the split is possible without impairing this aspect of its function. In this way, the disadvantageous weakening associated with an upwardly or downwardly open channel to receive the conduit, explained above with reference to the prior art, is avoided. Because the proximal end of the head support 10 is divided by the longitudinal portion 26 of the void 22, the split 46 need only be formed in one side of the head support 10, as can be appreciated from inspection of FIG. 1. In the present embodiment, the split 46 is formed such as to be normally closed. That is, the surfaces that form either side of the split are in contact when the head support 10 is not subject to a load.

The arrangement also provides positive lateral location of the conduit in use, since the head support 10 must be deformed to withdraw the conduit laterally.

The head support 10 is sized and proportioned for an adult but the present invention is equally applicable to smaller head supports for use with children.

Second Example

Figure 5:
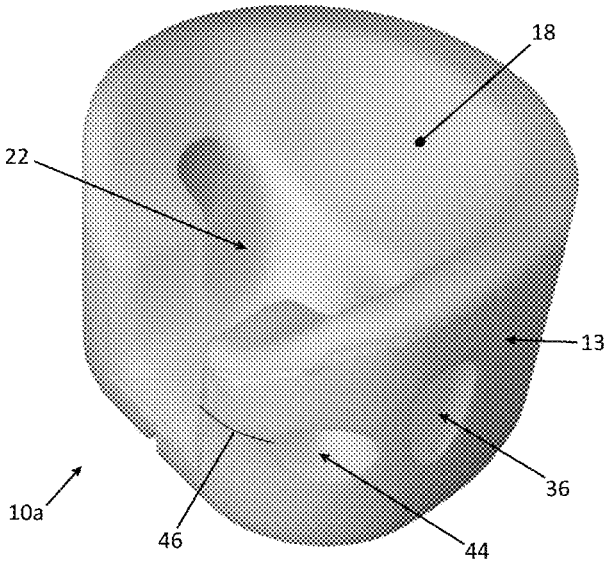
FIG. 5 represents a second head support embodying the present invention, viewed from above and one side.

FIG. 5 represents a second head support 10*a* for this purpose. This differs in size and proportion from the first head support 10 but possesses otherwise equivalent features of shape and function. The same reference numerals are used in FIG. 5 as in the earlier drawings and the description of the relevant features will not be repeated. A conspicuous distinction between the first and second head supports 10, 10*a* is that in the latter the longitudinal extent of the cheek support portions 28, 30 is smaller in proportion to the size of the forehead support portion 18, this being a reflection of the relative proportions of the head of a child and of an adult.

Figure 6:
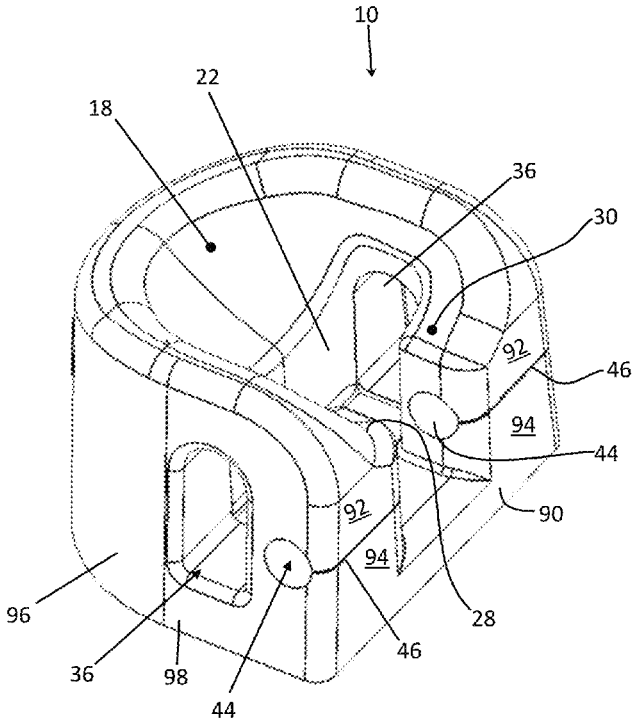
FIG. 6 is a perspective view of a third head support embodying the present invention, viewed from above, one side and the rear.
Figure 7:
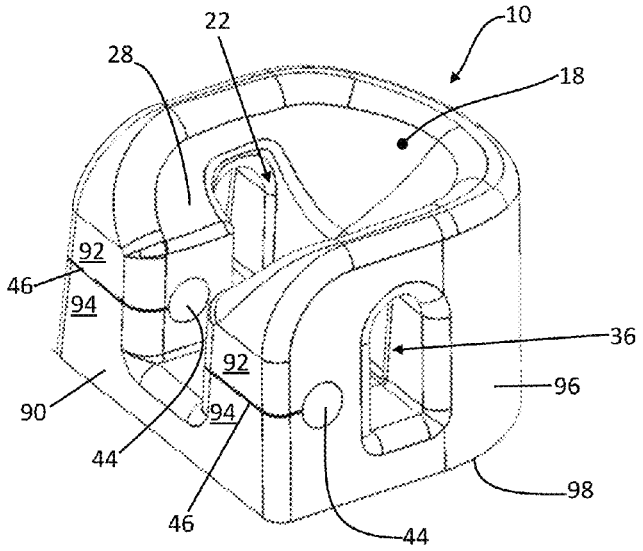
FIG. 7 is a perspective view of a fourth head support embodying the present invention, viewed from above, one side and the rear.
Figure 9:
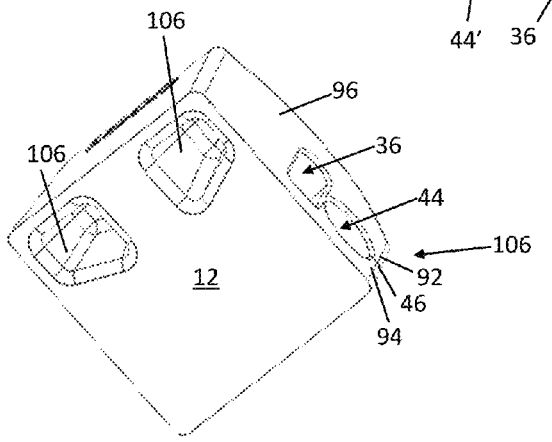
FIG. 9 is a perspective view of the head support of FIG. 8 viewed from below.

Referring now to the remaining drawings, namely FIGS. 6, 7 and 9; these are perspective views of various variations of the design of head supports embodying the invention.

Third Example

The head support shown in FIG. 6 is of a shape and size, which has been designed for supporting the head/face of a child/infant and has similar features to those described previously. For the avoidance of repetition, identical reference signs have been used to identify identical features in FIG. 6 as they have in relation to the previous drawings.

The main difference between the embodiment shown in FIG. 6 and that shown, say, in FIG. 5, which is also for an infant, is that the shape of the head support 10, when viewed from above, is more U-shaped than rounded. In this embodiment, the viewing opening 36 is generally D-shaped, whereas in previously-described embodiments, it is generally oval. Nevertheless, the head support 10 has a curved portion 18, which, in use, supports the forehead of a prone-positioned patient, as well as curved portions 28, 30 for supporting the cheeks of a prone-positioned patient. The central void 22 provides an opening such that the ocular/nasal/oral regions of the patient's face are unsupported—as previously described.

A through aperture 44 is provided on each side of the head support 10 through which, in use, an endotracheal tube (now shown) can be routed from the exterior of the head support 10 into the void 22 and so to the patient's mouth.

A horizontal slit 46 extends between a rear surface 90 of the head support 10 and the through hole 44, as previously described. In use, the regions of the foam 92, 94 located above and below, respectively, the slit 46 can be separated to enable an endotracheal tube (not shown) to be passed "through" the foam of the head support 10. This enables a patient to be intubated before his/her face is placed into the head support 10. In other words, it is possible to intubate a patient with an endotracheal tube (not shown) and to place the patient's head into the head support. The foam parts 92, 94 can be separated vertically, to open up the slit 46 to enable the endotracheal tube to be passed into the through hole 44 therefor. Upon releasing the foam portions 92, 94 they spring back together, and due to the horizontal orientation of the slit 46, loads applied vertically to the head support 10, for example downward pressure applied via the cheek support portions 28, 30 can be supported/transmitted into the operating table without separating/misaligning foam portions 92, 94 due to the horizontal orientation of the slit 46.

It can be seen, from FIG. 6, that the side walls 96 of the head support 10 are tapered inwardly slightly such that the base area of the head support 10 is slightly larger than the other part of the head support. This serves to better stabilise the head support 10 by it having a wider base and by positioning the centre of gravity of the patient's head as far away as possible from the side edges 98 of the head support 10.

Fourth Example

Referring now to FIG. 7, which is a similar embodiment of a head support 10 to that shown in FIG. 6, albeit it is of a slightly larger size, for example to fit a child/small adult. The basic design features of the embodiment shown in FIG. 7 are essentially the same as those shown in FIG. 6 and a further, detailed explanation is not, therefore, necessary.

Fifth Example

Figure 8:
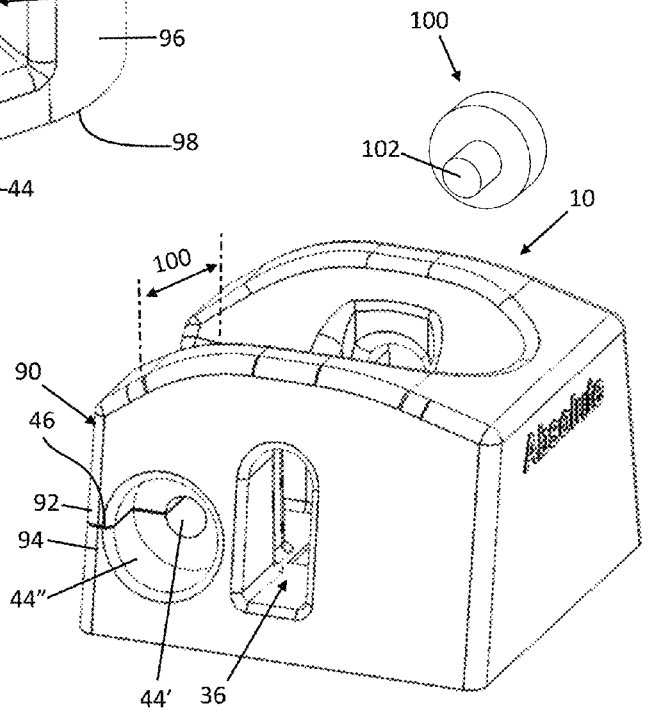
FIG. 8 is a perspective view of a fifth head support embodying the present invention, viewed from above, one side and the front.

The embodiment of the head support 10 shown in FIGS. 8 and 9 of the drawings is larger still than that shown in FIG. 7 and is essentially designed for use by adults. Again, this embodiment of the invention has the same essential features as previously-described embodiments and so further discussion has been omitted herein to avoid unnecessary repetition.

Notably, however, it will be seen that the embodiment of the invention shown in FIGS. 8 and 9 has a generally rectangular shape when viewed from above, rather than the generally D-shaped profile of the previously-described embodiments. Due to the increased size, and in particular, the increased width of this embodiment of the head support, it will be noted that the passage-way 44 through which the endotracheal tube (not shown) passes, in use, comprises a relatively narrower portion 44' leading to a generally wider portion 44". The reason for this is that the endotracheal tube (not shown) typically comprises a filter/connector part located a few centimeters away from the right-angled bend before it turns into the patient's mouth. The thickness 100 of the side wall 96 in this region is greater than the distance between the right-angled bend and that filter/connector, and so, unless the enlarged portion 44" were provided, the head support cushion 10 would interfere therewith.

Accordingly, the enlarged portion 44" of the through hole for the endotracheal tube is shaped and dimensioned to accommodate this connector/filter, thereby overcoming this potential issue. Nevertheless, it will be noted that the head support cushion 10 still comprises the same horizontal slit 46 as previously described, enabling foam parts 92, 94 to be separated vertically to enable an endotracheal tube to pass "through" the rear wall 90 of the head support cushion when a patient is placed into the head support cushion 10 already intubated.

An optional removable plug 100 of resilient material, ideally made from the same material as the main body of the head support 10, can be inserted into a conduit-routing opening 44, which is not in use. It will be appreciated, especially where the conduit-routing opening 44 comprises a relatively wider part 42', that the side wall of the head support 10 could be weakened due to a lack of material in that region. Therefore, a removable plug 100, which is ideally shaped and sized so as to be a snug push-fit into at least the relatively wider portion 44', but preferably also into the relatively narrower portion 44" of the conduit-routing opening 44, can be provided, which can be inserted into the conduit-routing opening 44 that is not in use. The removable plug 100 may therefore comprise a boss portion 102 that is shaped and sized so as to be a snug push-fit into the relatively narrower portion 44" of the conduit-routing opening 44.

It will be appreciated that the amount of foam required to make an "adult-sized" embodiment of the invention could be considerable. In order to reduce material usage and/or to adjust the softness/feel of the cushion, as can be seen in FIG. 9, one or more "material saving" voids can be provided in the base wall 12 (which can be seen to be a flat base wall 12 for stably supporting the head support 10 on a fat table surface).

Other Examples

The skilled person will readily appreciate that the illustrated embodiments are merely exemplary of the invention, and that various changes or modifications could be made without departing from the scope of the invention. For example, although the underside of the head support 10 is flat in the present embodiment, and is to rest directly upon an operating table, an alternative embodiment comprises a set of feet projecting form the support's underside. The form of the portions of the support which engage with the face may vary considerably without departing form the scope of the invention, as may the form of the clearance void. The illustrated head support 10 lacks any cradle or other mounting structure but the present invention may be applied to head supports of the type in which a foam body is carried on a more rigid support.

Statements Corresponding to the Claims of the Priority Application

The following statements are not the claims, but relate to various possible/preferable features of/or embodiments of the invention:

Statement 1. A head support for supporting a patient's head while the patient is in a prone position, the head support comprising a body of compliant material whose shape provides a forehead support region, at least one further support region for supporting a lower portion of the patient's face, and a void which accommodates the patient's eyes, nose and mouth in use, wherein a viewing opening is provided which faces laterally and provides in use a line of sight from the exterior of the head support into the void, the viewing opening having a periphery which is an unbroken loop.

Statement 2. The head support of statement 1, having a peripheral wall through which the viewing opening passes, material of the peripheral wall being unbroken above and below the viewing opening.

Statement 3. The head support of statement 1 or 2, in which the void comprises an upwardly open recess with a base wall.

Statement 4. The head support of statement 3, in which the base wall extends continuously from a proximal end of the void to a distal end of the void.

Statement 5. The head support of statement 3 or 4, in which the base wall is configured to support a mirror in a position which is such that in use a reflection of the face of the patient from the mirror is viewable through the viewing opening.

Statement 6. The head support of statement 3 or 4, in which the base supports a mirror in a position which is such that in use a reflection of the face of the patient from the mirror is viewable through the viewing opening.

Statement 7. The head support of any preceding statement, in which the viewing opening is on a first side of the head support and a further viewing opening is provided on a second side of the head support opposite the first.

Statement 8. The head support of any preceding statement, which comprises a unitary body of foam material.

Statement 9. The head support of statement 9, which is adapted to be placed upon a flat surface and to be used without any additional supporting structure or cradle.

Statement 10. The head support of any preceding statement, in which the further support regions comprise a pair of cheek support regions which lie on either side of a plane of symmetry of the head support and which incline downwardly toward the said plane.

Statement 11. The head support as of any preceding statement, in which the void comprises, in plan, a transverse region providing clearance at least for the eyes of the patient and a longitudinal region providing clearance at least for the nose of the patient.

Statement 12. The head support of any preceding claim, in which the forehead support region is concave in both transverse and longitudinal planes.

Statement 13. The head support of any preceding claim, further comprising a conduit-routing opening through which the void communicates with the exterior of the head support and which is configured to receive a conduit led in use from the said exterior to the face of the patient.

Statement 14. The head support of statement 13, in which the conduit-routing opening has a periphery which is a closed loop save for a slit which extends from the conduit-routing opening's periphery, so that by deforming the compliant material of the head support, the slit is able to be opened to enable a conduit to be introduced through the open slit to the conduit-routing opening, after which the head support is able to recover its original shape.

Statement 15. The head support as claimed in of statement 14, in which the slit lies in a plane which is substantially horizontal.

Statement 16. The head support of statement 14, 15 or 16, in which material on one side of the slit contacts material on the other side of the slit when the head support is not deformed by an applied force.

Statement 17. The head support of statement 14, 15, 16 or 17, in which the conduit-routing opening faces along a lateral direction.

Statement 18. The head support of statement 14, 15, 16, 17 or 18 in which the conduit-routing opening emerges into the void in a region of the head support which is adjacent the lower face of the patient, in use.

Statement 19. The head support of statement 14, 15, 16, 17, 18 or 19, in which the head support has an upright peripheral wall around the void and the conduit-routing opening extends through the peripheral wall.

Statement 20. The head support of statement 20 in which the peripheral wall is divided in a chin region of the head support and the slit extends to an edge formed by this divide.

Statement 21. The head support of any one of statements 14 to 21, in which the conduit-routing opening is circular.

Statement 22. A head support for supporting a patient's head while the patient is in a prone position, the head support comprising a body of compliant material whose shape provides a forehead support region, at least one further support region for supporting a lower portion of the patient's face, and a void which accommodates the patient's eyes, nose and mouth in use, the head support further comprising a conduit-routing opening through which the void communicates with the exterior of the head support, and a slit which extends from the conduit-routing opening's periphery, so that by deforming the compliant material of the head support, the slit is able to be opened to enable a conduit to be introduced through the open slit to the conduit-routing opening, after which the head support is able to recover its original shape.

Statement 23. The head support of statement 22, in which the slit is inclined by not more than thirty degrees to the horizontal.

Statement 24. The head support of statement 22, in which the slit lies in a plane which is substantially horizontal.

Statement 25. The head support of statement 22, 23 or 24, in which material on one side of the slit contacts material on the other side of the slit when the head support is not deformed by an applied force.

Statement 26. The head support of statement 22, 23, 24 or 25, in which the conduit-routing opening faces along a lateral direction.

Statement 27. The head support of any of statements 22 to 26, in which the conduit-routing opening emerges into the void in a region of the head support which is adjacent the lower face of the patient, in use.

Statement 28. The head support of statements 22 to 27, in which the head support has an upright peripheral wall around the void and the conduit-routing opening extends through the peripheral wall.

Statement 29. The head support of statement 28, in which the peripheral wall is divided in a chin region of the head support and the slit extends to an edge formed by this divide.

Statement 30. The head support of any one of statements 22 to 29, in which the conduit-routing opening is circular.

Statement 31. The head support of any one of statements 22 to 30, in which the periphery of the conduit-routing opening is, save for the slit, an unbroken loop.

Statement 32. The head support of any one of statements 22 to 31, in which the void comprises an upwardly open recess with a base wall.

Statement 33. The head support of statement 32, in which the base wall extends continuously from a proximal end of the void to a distal end of the void.

Statement 34. The head support of statement 32 or 33, in which the base wall is configured to support a mirror in a position which is such that in use a reflection of the face of the patient from the mirror is viewable through the viewing opening.

Statement 35. The head support of statement 32 or 33, in which the base supports a mirror in a position which is such that in use a reflection of the face of the patient from the mirror is viewable through the viewing opening.

Statement 36. The head support of any one of statements 22 to 35, which comprises a unitary body of foam material.

Statement 37. The head support of statement 36, which is adapted to be placed upon a surface and to be used without any further supporting structure or cradle.

Statement 38. The head support of statement 37, wherein an under-side of the head support is substantially flat.

Statement 39. The head support of statement 37, wherein an under-side of the head support has a convex curved profile.

Statement 40. The head support of statement 38 or statement 39, wherein the void intersects the under-side of the head support.

Statement 41. The head of any one of statements 22 to 40, which has further support regions in the form of a pair of cheek support regions which lie on either side of a plane of symmetry of the head support and which incline downwardly toward the said plane.

Statement 42. The head support of any one of statements 22 to 41, in which the void comprises, in plan, a transverse region providing clearance at least for the eyes of the patient and a longitudinal region providing clearance at least for the nose of the patient.

Statement 43. The head support of any one of statements 22 to 42, in which the forehead support region is concave in both transverse and longitudinal planes.

Statement 44. A method of routing a conduit into a head support for supporting a patient's head while the patient is in a prone position, the head support comprising a body of compliant material whose shape provides a forehead support region, at least one further support region for supporting a lower portion of the patient's face, and a void which accommodates the patient's eyes, nose and mouth in use, the head support further comprising a conduit-routing opening through which the void communicates with the exterior of the head support, and a slit which extends from the conduit-routing opening's periphery, and the method comprising deforming the compliant material of the head support to open the slit, introducing the conduit along a direction transverse to its length through the slit into the conduit-routing opening, and releasing the head support causing it to recover its original shape and close the slit.

The invention claimed is:

1. A head support for supporting a patient's head while the patient is in a prone position, the head support comprising:

a body of compliant material whose shape provides a forehead support region, at least one further support region for supporting a lower portion of the patient's face, and a void which accommodates the patient's eyes, nose and mouth in use, wherein a viewing opening is provided which faces laterally and provides a line of sight from the exterior of the head support into the void, the viewing opening having a periphery which is an unbroken loop, and wherein the head support comprises a conduit-routing opening through which the void communicates with the exterior of the head support and which is configured to receive a conduit led, in use, from the said exterior to the face of the patient, the conduit-routing opening having a periphery which is a closed loop save for a slit which extends substantially horizontally from the conduit-routing opening's periphery, so that by deforming the compliant material of the head support, the slit is able to be opened to enable a conduit to be introduced through the open slit to the conduit-routing opening, after which the head support is able to recover its original shape.

2. The head support of claim 1, in which the void comprises an upwardly open recess with a base wall extending continuously from a proximal end of the void to a distal end of the void.

3. The head support of claim 2 in which the base wall is configured to support a mirror, or which comprises a mirror, in a position which is such that in use a reflection of the face of the patient from the mirror is viewable through the viewing opening.

4. The head support of claim 1, which comprises a unitary body of foam material.

5. The head support of claim 1, wherein an under-side of the head support is substantially flat.

6. The head support of claim 5, wherein the underside is adapted to be placed upon a flat surface and to be used without any additional supporting structure or cradle.

7. The head support of claim 1, wherein an under-side of the head support has a convex curved profile.

8. The head support of claim 1, in which material on one side of the slit contacts material on the other side of the slit when the head support is not deformed by an applied force.

9. The head support of claim 1, wherein the conduit-routing opening faces along a lateral direction and which emerges into the void in a region of the head support which is adjacent the lower face of the patient, in use.

10. The head support of claim 1, further comprising a removable plug of resilient material, the removable plug being shaped and sized so as to be a snug push-fit into the conduit-routing opening.

11. The head support of claim 10, wherein the conduit-routing opening is circular, and comprises a relatively wider portion leading to a relatively narrower portion, the removable plug comprising a boss portion that is shaped and sized so as to be a snug push-fit into the relatively narrower portion of the conduit-routing opening.

12. The head support of claim 1, in which the periphery of the conduit-routing opening is, save for the slit, an unbroken loop.

13. The head support of claim 1, wherein the slit is inclined by not more than thirty degrees to the horizontal.

14. The head support of claim 1, wherein the void intersects an under-side of the head support.

15. The head support of claim 1, in which the void comprises, in plan, a transverse region providing clearance at least for the eyes of the patient and a longitudinal region providing clearance at least for the nose of the patient.

16. The head support of claim 1, in which the forehead support region is concave in both transverse and longitudinal planes.

17. The head support of claim 1, further comprising support regions being a pair of cheek support regions which lie on either side of a plane of symmetry of the head support and which incline downwardly toward the said plane.

18. The head support of claim 10, wherein the conduit-routing opening is circular, and comprises a relatively wider portion leading to a relatively narrower portion, the removable plug comprising a boss portion that is shaped and sized so as to be a snug push-fit into the relatively wider portion of the conduit-routing opening.

* * * * *